US011270663B2

(12) United States Patent
Yu et al.

(10) Patent No.: US 11,270,663 B2
(45) Date of Patent: Mar. 8, 2022

(54) METHOD FOR DETECTING COMPENSATION PARAMETERS OF BRIGHTNESS, METHOD FOR COMPENSATING BRIGHTNESS, DETECTION DEVICE FOR DETECTING COMPENSATION PARAMETERS OF BRIGHTNESS, BRIGHTNESS COMPENSATION DEVICE, DISPLAY DEVICE, AND NON-VOLATILE STORAGE MEDIUM

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Yong Yu, Beijing (CN); Chuanyan Lan, Beijing (CN); Lixia Shen, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/758,550

(22) PCT Filed: Apr. 22, 2019

(86) PCT No.: PCT/CN2019/083692

§ 371 (c)(1),
(2) Date: Apr. 23, 2020

(87) PCT Pub. No.: WO2020/215179

PCT Pub. Date: Oct. 29, 2020

(65) Prior Publication Data

US 2021/0166654 A1 Jun. 3, 2021

(51) Int. Cl.

| | |
|---|---|
| ***G09G 5/10*** | (2006.01) |
| ***G09G 3/20*** | (2006.01) |
| *G09G 3/3208* | (2016.01) |

(52) U.S. Cl.

CPC ..... *G09G 5/10* (2013.01); *G09G 3/2007* (2013.01); *G09G 3/3208* (2013.01); (Continued)

(58) Field of Classification Search

None

See application file for complete search history.

(56) References Cited

U.S. PATENT DOCUMENTS

| | | | |
|---|---|---|---|
| 9,536,498 | B2 | 1/2017 | Wu et al. |
| 10,573,236 | B1 | 2/2020 | Gao et al. |

(Continued)

FOREIGN PATENT DOCUMENTS

| | | | |
|---|---|---|---|
| CN | 103474016 | A | 12/2013 |
| CN | 103500566 | A | 1/2014 |

(Continued)

*Primary Examiner* — Amr A Awad
*Assistant Examiner* — Donna V Bocar
(74) *Attorney, Agent, or Firm* — Dilworth & Barrese, LLP; Michael J. Musella, Esq.

(57) ABSTRACT

A method and device for detecting compensation parameters of brightness, a method and device for compensating brightness, a display device, and a non-volatile storage medium are disclosed. The method for detecting compensation parameters is applied for a display panel, and the display panel includes a first region and a second region, which include first pixel units arranged and second pixel units arranged, respectively. The method includes selecting a first target region from the first region, and determining a first compensation parameter, according to brightness of the first target region, for at least part of the first pixel units in the first region to perform brightness compensation; and selecting a second target region from the second region, and (Continued)

determining a second compensation parameter, according to brightness of the second target region, for at least part of the second pixel units in the second region to perform brightness compensation.

16 Claims, 6 Drawing Sheets

(52) U.S. Cl.
CPC ..... *G09G 2320/029* (2013.01); *G09G 2320/0233* (2013.01); *G09G 2320/0276* (2013.01); *G09G 2320/0626* (2013.01); *G09G 2320/0693* (2013.01); *G09G 2360/145* (2013.01); *G09G 2360/16* (2013.01)

(56) References Cited

U.S. PATENT DOCUMENTS

| | | | | |
|---|---|---|---|---|
| 2016/0307511 | A1 | 10/2016 | Fujii | |
| 2017/0345377 | A1* | 11/2017 | Oh | G09G 3/3291 |
| 2020/0251033 | A1* | 8/2020 | Ma | G09G 3/20 |
| 2020/0279519 | A1* | 9/2020 | Orio | G09G 3/20 |
| 2021/0104210 | A1* | 4/2021 | Otoi | G09G 3/3208 |

FOREIGN PATENT DOCUMENTS

| | | | |
|---|---|---|---|
| CN | 105259687 | A | 1/2016 |
| CN | 109584798 | A | 4/2019 |
| KR | 1020060086170 | A | 7/2006 |

* cited by examiner

METHOD FOR DETECTING COMPENSATION PARAMETERS OF BRIGHTNESS, METHOD FOR COMPENSATING BRIGHTNESS, DETECTION DEVICE FOR DETECTING COMPENSATION PARAMETERS OF BRIGHTNESS, BRIGHTNESS COMPENSATION DEVICE, DISPLAY DEVICE, AND NON-VOLATILE STORAGE MEDIUM

TECHNICAL FIELD

Embodiments of the present disclosure relate to a method for detecting compensation parameters of brightness, a method for compensating brightness, a detection device for detecting compensation parameters of brightness, a brightness compensation device, a display device, and a non-volatile storage medium.

BACKGROUND

Because the distance between the pixel units in different regions of a display panel and a driving circuit is different, the IR drop on the signal traces that are connected to the pixel units in different regions are also different, so that the display panel may occur problems of poor display such as display mura, or the like. In this case, the brightness of the display panel needs to be compensated.

SUMMARY

At least one embodiment of the present disclosure provides a method for detecting compensation parameters of brightness of a display panel, a display region of the display panel comprises a first region and a second region, the first region comprises a plurality of first pixel units arranged in a first array, the second region comprises a plurality of second pixel units arranged in a second array, and the first region and the second region are different regions; the method comprises selecting a first target region from the first region, and determining a first compensation parameter, according to brightness of the first target region, for at least part of the first pixel units in the first region to perform brightness compensation according to the first compensation parameter; and selecting a second target region from the second region, and determining a second compensation parameter, according to brightness of the second target region, for at least part of the second pixel units in the second region to perform brightness compensation according to the second compensation parameter.

For example, in the method for detecting compensation parameters of brightness provided by an embodiment of the present disclosure, the first region is divided into a plurality of first compensation units, and the first compensation units each comprise at least one of the first pixel units; determining the first compensation parameter, according to the brightness of the first target region, comprises obtaining a grayscale data corresponding to a brightness data of each of the first compensation units according to a gamma curve of the display panel, and causing the each of the first compensation units to determine a corresponding first compensation parameter according to a grayscale data corresponding to the first target region; the second region is divided into a plurality of second compensation units, and the second compensation units each comprise at least one of the second pixel units; and determining the second compensation parameter, according to the brightness of the second target region, comprises obtaining a grayscale data corresponding to a brightness data of each of the second compensation units according to the gamma curve of the display panel, and causing the each of the second compensation units to determine a corresponding second compensation parameter according to a grayscale data corresponding to the second target region.

For example, in the method for detecting compensation parameters of brightness provided by an embodiment of the present disclosure, causing the each of the first compensation units to determine the corresponding first compensation parameter according to the grayscale data corresponding to the first target region comprises: inputting a monochromatic image with a first grayscale value to the first region, and then, acquiring a brightness data set of all the first pixel units in the first region and taking the brightness data set as a first brightness data, and obtaining a first target brightness value $YG_1$ of the first target region according to the first brightness data, in which the first target brightness value $YG_1$ is an average value of brightness data of all the first pixel units in the first target region; obtaining a first original brightness value $XG_1$ of the each of the first compensation units according to the first brightness data, in which the first original brightness value $XG_1$ is an average value of brightness data of all the first pixel units in the each of the first compensation units; obtaining a first target grayscale value $Y_1$ corresponding to the first target brightness value $YG_1$ according to the gamma curve, and obtaining a first original grayscale value $X_1$ corresponding to the first original brightness value $XG_1$ according to the gamma curve; inputting a monochromatic image with a second grayscale value to the first region, and then, acquiring a brightness data set of all the first pixel units in the first region and taking the brightness data set as a second brightness data, and obtaining a second target brightness value $YG_2$ of the first target region according to the second brightness data, in which the second target brightness value $YG_2$ is an average value of brightness data of all the first pixel units in the first target region; obtaining a second original brightness value $XG_2$ of the each of the second compensation units according to the second brightness data, in which the second original brightness value $XG_2$ is an average value of brightness data of all the first pixel units in the each of the first compensation units; obtaining a second target grayscale value $Y_2$ corresponding to the second target brightness value $YG_2$ according to the gamma curve, and obtaining a second original grayscale value $X_2$ corresponding to the second original brightness value $XG_2$ according to the gamma curve; and calculating a first compensation gain value $A_1$ and a first compensation deviation value B corresponding to the each of the first compensation units according to the following equations: $A_1*X_1+B_1=Y_1$, $A_1*X_2+B=Y_2$, in which the first compensation parameter comprises the first compensation gain value and the first compensation deviation value.

For example, in the method for detecting compensation parameters of brightness provided by an embodiment of the present disclosure, causing the each of the second compensation units to determine the corresponding second compensation parameter according to the grayscale data corresponding to the second target region comprises: inputting the monochromatic image with the first grayscale value to the second region, and then, acquiring a brightness data set of all the second pixel units in the second region and taking the brightness data set as a third brightness data, and obtaining a third target brightness value $YG_3$ of the second target region according to the third brightness data, in which the third target brightness value $YG_3$ is an average value of brightness data of all the second pixel units in the second target region; obtaining a third original brightness value $XG_3$ of the each of the second compensation units according to the third brightness data, in which the third original brightness value $XG_3$ is an average value of brightness data of all the second pixel units in the each of the second compensation units; obtaining a third target grayscale value $Y_3$ corresponding to the third target brightness value $YG_3$ according to the gamma curve, and obtaining a third original grayscale value $X_3$ corresponding to the third original brightness value $XG_3$ according to the gamma curve; inputting the monochromatic image with the second grayscale value to the second region, and then, acquiring a brightness data set of all the second pixel units in the second region and taking the brightness data set as a fourth brightness data, and obtaining a fourth target brightness value $YG_4$ of the second target region according to the fourth brightness data, in which the fourth target brightness value $YG_4$ is an average value of brightness data of all the second pixel units in the second target region; obtaining a fourth original brightness value $XG_4$ of the each of the second compensation units according to the fourth brightness data, in which the fourth original brightness value $XG_4$ is an average value of brightness data of all the second pixel units in the each of the second compensation units; obtaining a fourth target grayscale value $Y_4$ corresponding to the fourth target brightness value $YG_4$ according to the gamma curve, and obtaining a fourth original grayscale value $X_4$ corresponding to the fourth original brightness value $XG_4$ according to the gamma curve; and calculating a second compensation gain value $A_2$ and a second compensation deviation value $B_2$ corresponding to the each of the second compensation units according to the following equations: $A_2*X_3+B_2=Y_3$, $A_2*X_4+B_2=Y_4$, in which the second compensation parameter comprises the second compensation gain value and the second compensation deviation value.

For example, in the method for detecting compensation parameters of brightness provided by an embodiment of the present disclosure, inputting the monochromatic image with the first grayscale value to the first region and inputting the monochromatic image with the first grayscale value to the second region are performed simultaneously; and inputting the monochromatic image with the second grayscale value to the first region and inputting the monochromatic image with the second grayscale value to the second region are performed simultaneously.

For example, the method for detecting compensation parameters of brightness provided by an embodiment of the present disclosure further comprises filtering the first brightness data to eliminate noise after obtaining the first brightness data; and filtering the second brightness data to eliminate noise after obtaining the second brightness data.

For example, in the method for detecting compensation parameters of brightness provided by an embodiment of the present disclosure, acquiring the first brightness data comprises photographing the display panel with an image capturing device to obtain a first image data; and acquiring the first brightness data according to the first image data and configuration parameters of the image capturing device.

For example, in the method for detecting compensation parameters of brightness provided by an embodiment of the present disclosure, the first grayscale value comprises a value being ⅛ of a maximum grayscale value, and the second grayscale value comprises a value being ⅞ of the maximum grayscale value.

For example, in the method for detecting compensation parameters of brightness provided by an embodiment of the present disclosure, the each of the first compensation units and the each of the second compensation units are equal in size.

For example, in the method for detecting compensation parameters of brightness provided by an embodiment of the present disclosure, the first target region comprises a first pixel unit, brightness of which is lower than a preset value, in the first region of the display panel.

For example, in the method for detecting compensation parameters of brightness provided by an embodiment of the present disclosure, the second target region comprises a second pixel unit, which is located at a center position, in the second region of the display panel.

For example, in the method for detecting compensation parameters of brightness provided by an embodiment of the present disclosure, the first region comprises a protruding region located at a side of the display panel, and the second region comprises a region located at a center position of the display region.

At least one embodiment of the present disclosure provides a method for compensating brightness of a display panel, a display region of the display panel comprises a first region and a second region, the first region comprises a plurality of first pixel units arranged in a first array, the second region comprises a plurality of second pixel units arranged in a second array, and the first region and the second region are different regions; the method comprises causing at least part of the first pixel units in the first region to perform brightness compensation according to a first compensation parameter, and causing at least part of the second pixel units in the second region to perform brightness compensation according to a second compensation parameter, in which the first compensation parameter is determined based on brightness of a first target region, and the first region comprises the first target region; and the second compensation parameter is determined based on brightness of a second target region, and the second region comprises the second target region.

For example, in the method for compensating brightness provided by an embodiment of the present disclosure, the first region is divided into a plurality of first compensation units, and causing at least part of the first pixel units in the first region to perform the brightness compensation according to the first compensation parameter comprises causing the first region to perform the brightness compensation according to the first compensation parameter with using the first compensation units as a smallest unit; the second region is divided into a plurality of second compensation units, and causing at least part of the second pixel units in the second region to perform the brightness compensation according to the second compensation parameter comprises causing the second region to perform the brightness compensation according to the second compensation parameter with using the second compensation units as a smallest unit.

For example, in the method for compensating brightness provided by an embodiment of the present disclosure, the first compensation parameter comprises a first compensation gain value $A_1$ and a first compensation deviation value $B_1$, and brightness of a first pixel unit in one of the first compensation units is compensated according to the following equation: $A_1*X_{O1}+B_1=Y_{A1}$, in which $X_{O1}$ is a grayscale value of the first pixel unit in the one of the first compensation units before the first pixel unit is compensated, and $Y_{A1}$ is a grayscale value of the first pixel unit in the one of the first compensation units after the first pixel unit is compensated; the second compensation parameter comprises a second compensation gain value $A_2$ and a second compensation deviation value $B_2$, and brightness of a second pixel unit in one of the second compensation units is compensated according to the following equation: $A_2*X_{O2}+B_2=Y_{A2}$, in which $X_{O2}$ is a grayscale value of the second pixel unit in the one of the second compensation units before the second pixel unit is compensated, and $Y_{A2}$ is a grayscale value of the second pixel unit in the one of the second compensation units after the second pixel unit is compensated.

At least one embodiment of the present disclosure provides a detection device for detecting compensation parameters of brightness of a display panel, a display region of the display panel comprises a first region and a second region, the first region comprises a plurality of first pixel units arranged in a first array, the second region comprises a plurality of second pixel units arranged in a second array, the first region and the second region are different regions, and the detection device comprises a two-dimensional target calculation unit and a compensation parameter calculation unit; the two-dimensional target calculation unit is configured to select a first target region from the first region and select a second target region from the second region; and the compensation parameter calculation unit is configured to determine a first compensation parameter, according to brightness of the first target region, for at least part of the first pixel units in the first region to perform brightness compensation according to the first compensation parameter, and to determine a second compensation parameter, according to brightness of the second target region, for at least part of the second pixel units in the second region to perform brightness compensation according to the second compensation parameter.

For example, in the detection device for detecting compensation parameters of brightness provided by an embodiment of the present disclosure, the first region is divided into a plurality of first compensation units, and the first compensation units each comprise at least one of the first pixel units; the two-dimensional target calculation unit is further configured to obtain a grayscale data corresponding to a brightness data of each of the first compensation units according to a gamma curve of the display panel, and the compensation parameter calculation unit is further configured to determine a first compensation parameter corresponding to the each of the first compensation units according to a grayscale data corresponding to the first target region; the second region is divided into a plurality of second compensation units, and the second compensation units each comprise at least one of the second pixel units; and the two-dimensional target calculation unit is further configured to obtain a grayscale data corresponding to a brightness data of each of the second compensation units according to the gamma curve of the display panel, and the compensation parameter calculation unit is further configured to determine a second compensation parameter corresponding to the each of the second compensation units according to a grayscale data corresponding to the second target region.

For example, the detection device for detecting compensation parameters of brightness provided by an embodiment of the present disclosure further comprises a brightness acquisition unit, the two-dimensional target calculation unit is further configured to input a monochromatic image with a first grayscale value to the first region, and the brightness acquisition unit is configured to acquire a brightness data set of all the first pixel units in the first region when the first region displays the monochromatic image with the first grayscale value, and to take the brightness data set as a first brightness data; the two-dimensional target calculation unit is further configured to obtain a first target brightness value $YG_1$ of the first target region according to the first brightness data, the first target brightness value $YG_1$ is an average value of brightness data of all the first pixel units in the first target region, the two-dimensional target calculation unit is further configured to obtain a first original brightness value $XG_1$ of the each of the first compensation units according to the first brightness data, and the first original brightness value $XG_1$ is an average value of brightness data of all the first pixel units in the each of the first compensation units; the two-dimensional target calculation unit is further configured to obtain a first target grayscale value $Y_1$ corresponding to the first target brightness value $YG_1$ according to the gamma curve, and to obtain a first original grayscale value $X_1$ corresponding to the first original brightness value $XG_1$ according to the gamma curve; the two-dimensional target calculation unit is further configured to input a monochromatic image with a second grayscale value to the first region, and the brightness acquisition unit is further configured to acquire a brightness data set of all the first pixel units in the first region when the first region displays the monochromatic image with the second grayscale value and to take the brightness data set as a second brightness data; the two-dimensional target calculation unit is further configured to obtain a second target brightness value $YG_2$ of the first target region according to the second brightness data, the second target brightness value $YG_2$ is an average value of brightness data of all the first pixel units in the first target region, the two-dimensional target calculation unit is further configured to obtain a second original brightness value $XG_2$ of the each of the first compensation units according to the second brightness data, and the second original brightness value $XG_2$ is an average value of brightness data of all the first pixel units in the each of the first compensation units; the two-dimensional target calculation unit is further configured to obtain a second target grayscale value $Y_2$ corresponding to the second target brightness value $YG_2$ according to the gamma curve, and to obtain a second original grayscale value $X_2$ corresponding to the second original brightness value $XG_2$ according to the gamma curve; and the compensation parameter calculation unit is further configured to calculate a first compensation gain value $A_1$ and a first compensation deviation value $B_1$ corresponding to the each of the first compensation units according to the following equations: $A_1*X_1+B_1=Y_1$, $A_1*X_2+B_1=Y_2$, and the first compensation parameter comprises the first compensation gain value and the first compensation deviation value.

For example, in the detection device for detecting compensation parameters of brightness provided by an embodiment of the present disclosure, the two-dimensional target calculation unit is further configured to input the monochromatic image with the first grayscale value to the second region, and the brightness acquisition unit is further configured to acquire a brightness data set of all the second pixel units in the second region when the second region displays the monochromatic image with the first grayscale value and to take the brightness data set as a third brightness data; the two-dimensional target calculation unit is further configured to obtain a third target brightness value $YG_3$ of the second target region according to the third brightness data, the third target brightness value $YG_3$ is an average value of brightness data of all the second pixel units in the second target region, the two-dimensional target calculation unit is further configured to obtain a third original brightness value $XG_3$ of the each of the second compensation units according to the third brightness data, and the third original brightness value $XG_3$ is an average value of brightness data of all the second pixel units in the each of the second compensation units; the two-dimensional target calculation unit is further configured to obtain a third target grayscale value $Y_3$ corresponding to the third target brightness value $YG_3$ according to the gamma curve, and to obtain a third original grayscale value $X_3$ corresponding to the third original brightness value $XG_3$ according to the gamma curve; the two-dimensional target calculation unit is further configured to input the monochromatic image with the second grayscale value to the second region, and the brightness acquisition unit is further configured to acquire a brightness data set of all the second pixel units in the second region when the second region displays the monochromatic image with the second grayscale value and to take the brightness data set as a fourth brightness data; the two-dimensional target calculation unit is further configured to obtain a fourth target brightness value $YG_4$ of the second target region according to the fourth brightness data, the fourth target brightness value $YG_4$ is an average value of brightness data of all the second pixel units in the second target region, the two-dimensional target calculation unit is further configured to obtain a fourth original brightness value $XG_4$ of the each of the second compensation units according to the fourth brightness data, and the fourth original brightness value $XG_4$ is an average value of brightness data of all the second pixel units in the each of the second compensation units; the two-dimensional target calculation unit is further configured to obtain a fourth target grayscale value $Y_4$ corresponding to the fourth target brightness value $YG_4$ according to the gamma curve, and to obtain a fourth original grayscale value $X_4$ corresponding to the fourth original brightness value $XG_4$ according to the gamma curve; and the compensation parameter calculation unit is further configured to calculate a second compensation gain value $A_2$ and a second compensation deviation value $B_2$ corresponding to the each of the second compensation units according to the following equations: $A_2*X_3+B_2=Y_3$, $A_2*X_4+B_2=Y_4$, and the second compensation parameter comprises the second compensation gain value and the second compensation deviation value.

For example, in the detection device for detecting compensation parameters of brightness provided by an embodiment of the present disclosure, the brightness acquisition unit comprises an image capturing device.

For example, the detection device for detecting compensation parameters of brightness provided by an embodiment of the present disclosure further comprises a filtering unit, and the filtering unit is configured to filter the first brightness data to eliminate noise after the brightness acquire unit obtains the first brightness data, and to filter the second brightness data to eliminate noise after the brightness acquire unit obtains the second brightness data.

At least one embodiment of the present disclosure provides a brightness compensation device for compensating brightness of a display panel, a display region of the display panel comprises a first region and a second region, the first region comprises a plurality of first pixel units arranged in a first array, the second region comprises a plurality of second pixel units arranged in a second array, and the first region and the second region are different regions; the brightness compensation device is configured to cause at least part of the first pixel units in the first region to perform brightness compensation according to a first compensation parameter, and to cause at least part of the second pixel units in the second region to perform brightness compensation according to a second compensation parameter. The first compensation parameter is determined based on brightness of a first target region, and the first region comprises the first target region; and the second compensation parameter is determined based on brightness of a second target region, and the second region comprises the second target region.

At least one embodiment of the present disclosure provides a non-volatile storage medium, the storage medium stores computer instructions executable by a processor, and the computer instructions are capable of being executed by the processor to implement any method for detecting compensation parameters of brightness provided by the embodiments of the present disclosure.

At least one embodiment of the present disclosure provides a detection device for detecting compensation parameters of brightness, which comprises a processor and a non-volatile storage medium, the storage medium is configured to store computer instructions executable by the processor, and the computer instructions are capable of being executed by the processor to implement any method for detecting compensation parameters of brightness provided by the embodiments of the present disclosure.

At least one embodiment of the present disclosure provides a display device, which comprises any brightness compensation device provided by the embodiments of the present disclosure, and a display panel, and the brightness compensation device compensates brightness of the display panel when the display panel performs a display operation.

BRIEF DESCRIPTION OF THE DRAWINGS

In order to clearly illustrate the technical solution of the embodiments of the present disclosure, the drawings of the embodiments will be briefly described in the following. It is obvious that the described drawings in the following are only related to some embodiments of the present disclosure and thus are not limitative of the present disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", "coupled", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1A:
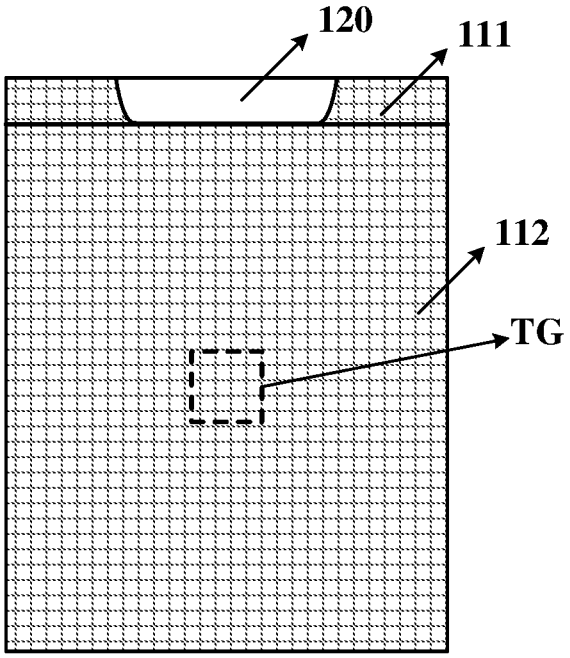
FIG. 1A is a schematic diagram of a display panel.

With the increasing demand of users for mobile screen, manufacturers launch mobile phone products that use a "full screen". However, because cameras, light sensors, distance sensors and other devices need to be installed on the front of the mobile phone, most of the current "full screen" mobile phones have a "notch region". FIG. 1A illustrates a schematic diagram of a display panel having a "notch region". As illustrated in FIG. 1A, the display region of the display panel includes a first region 111 and a second region 112, the first region 111 and the second region 112 are different regions, and the display region is used to display images. In addition, the display panel further includes a "notch region" 120, and devices such as a camera, a light sensor, and a distance sensor are provided in the "notch region" 120, so in general, the "notch region" 120 cannot be used to display images. The first region 111 is a region close to the "notch region" 120, and the second region 112 is the region other than the first region 111 in the display region.

It should be noted that FIG. 1A only schematically illustrates a display panel having a "notch region", and the embodiments of the present disclosure do not limit the position and size of the "notch region". In addition, the sizes of the first region 111 and the second region 112 are also schematic, and the following embodiments are the same and are not be described in detail.

As illustrated in FIG. 1A, because devices such as a camera and the like need to be provided in the "notch region" 120 of the display panel, these devices need to be correspondingly provided with signal traces and a driving circuit (or a detection circuit), so the panel layout of the region close to the "notch region" 120, that is the first region 111, and the panel layout of the second region 112 may be different. In addition, the driving circuit (or driving chip) of the display panel is generally provided at an end away from the first region 111, and the display scanning of the display panel is, for example, a scanning operation from the far end away from the driving circuit to the near end close to the driving circuit. Because the pixel units in the first region 111 is farther from the driving circuit than the pixel units in the second region 112, the IR drop of the signal trace used to drive the pixel units in the first region 111 is greater than the IR drop of the signal trace used to drive the pixel units in the second region 112, so the display panel may occur the problem of display mura, for example, the brightness of the pixel units in the first region 111 is lower than the brightness of the pixel units in the second region 112, and the display panel may display an obvious block display phenomenon when displaying an image.

Figure 1B:
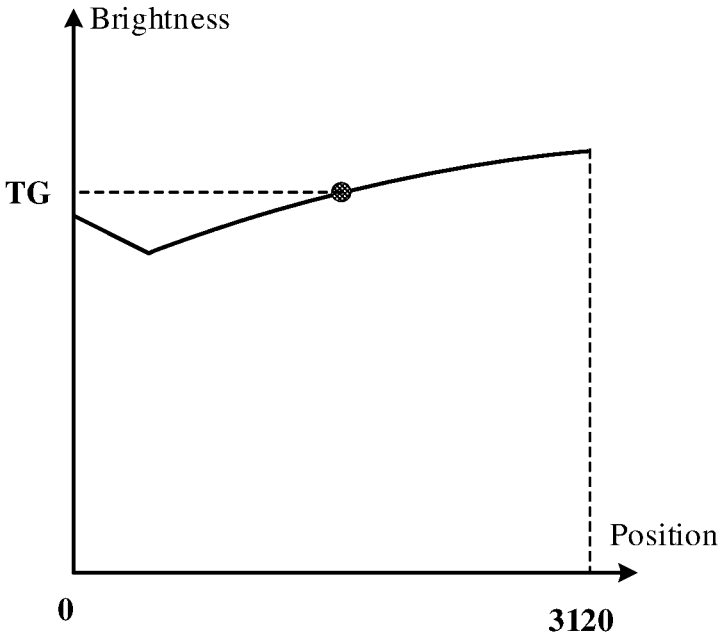
FIG. 1B is a change curve corresponding to the brightness of pixel units at different positions in the display panel corresponding to FIG. 1A.

FIG. 1B is a change curve corresponding to the brightness of pixel units at different positions in the display panel corresponding to FIG. 1A. As illustrated in FIG. 1B, the abscissa indicates the number of rows of the display panel, for example, the display panel includes 3120 rows of pixel units, and the ordinate indicates the brightness at the corresponding position. As illustrated in FIG. 1B, because of the influence of the panel layout and the difference in IR drop, the first region 111 may include the region with the lowest brightness, and in the second region 112, as the number of rows increases, the brightness gradually increases.

For the problem of display mura that occurs in the display panel illustrated in FIG. 1A above, a method for compensating brightness can be used to compensate the brightness of the display panel, thereby alleviating or avoiding the problem of display mura.

For example, as illustrated in FIG. 1A, a target region TG is selected from the second region 112 firstly. For example, the target region TG includes pixel units at the center position of the second region 112, for example, the target region TG includes 100 rows and 100 columns of pixel units. It should be noted that the embodiments of the present disclosure do not limit the size of the target region TG.

Then, the average value of the brightness of the target region TG is taken as a target brightness, and other regions in the display panel except for the target region TG all perform brightness compensation based on the target brightness. For example, the display panel is an OLED (Organic Light-Emitting Diode) display panel, and brightness of a pixel unit can be changed by adjusting the grayscale value provided to the pixel unit.

For example, in the case where the grayscale value is represented by a data of 8-bit (256 grayscale values from 0 to 255), the maximum grayscale value is 255. For example, in the case where the grayscale values of all pixel units provided to the display panel are 255, that is, the highest brightness is to be displayed, then pixel units with the brightness lower than the target brightness of the target region TG may appear in the first region 111 and the second region 112. In this case, because of the limitation of the number of bits, these pixel units can no longer increase the brightness by increasing the grayscale value and thus cannot perform brightness compensation. In addition, because the panel layouts of the first region 111 and the second region 112 are quite different, if the pixel units in the first region 111 is also compensated by the brightness data of the target region in the second region 112, it may not be possible to perform effective brightness compensation.

At least one embodiment of the present disclosure provides a method for detecting compensation parameters of brightness of a display panel, a display region of the display panel includes a first region and a second region, the first region includes a plurality of first pixel units arranged in a first array, the second region includes a plurality of second pixel units arranged in a second array, and the first region and the second region are different regions. The method includes selecting a first target region from the first region, and determining a first compensation parameter, according to brightness of the first target region, for at least part of the first pixel units in the first region to perform brightness compensation according to the first compensation parameter; and selecting a second target region from the second region, and determining a second compensation parameter, according to brightness of the second target region, for at least part of the second pixel units in the second region to perform brightness compensation according to the second compensation parameter. At least some embodiments of the present disclosure further provide a method for compensating brightness, a detection device for detecting compensation parameters of brightness, a brightness compensation device, a display device, and a non-volatile storage medium corresponding to the method for detecting compensation parameters of brightness.

The method for detecting compensation parameters of brightness, the method for compensating brightness, the detection device for detecting compensation parameters of brightness, the brightness compensation device, the display device, and the non-volatile storage medium provided in at least one embodiment of the present disclosure can perform brightness compensation on different regions in the display panel, thereby alleviating or avoiding problems of poor display such as uneven brightness between different regions of the display panel.

The embodiments of the present disclosure are described in detail below with reference to the accompanying drawings.

Figure 2:
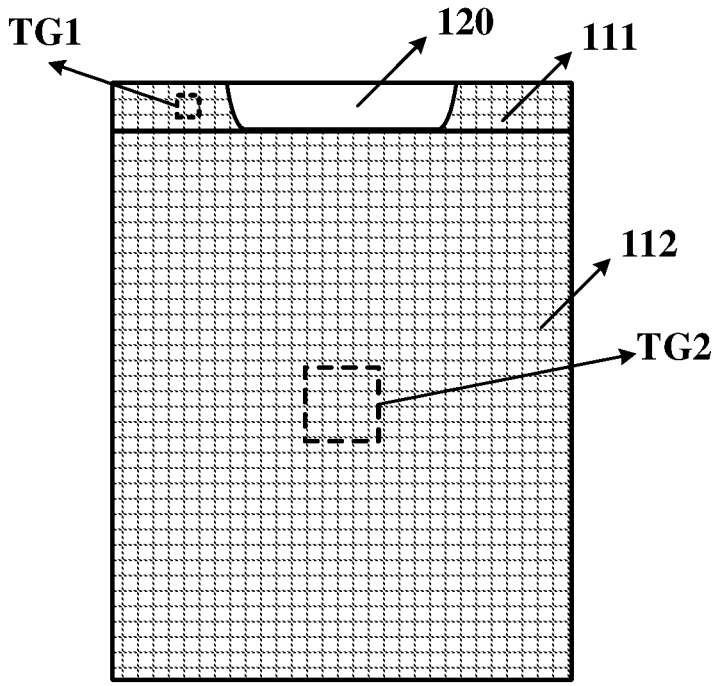
FIG. 2 is a schematic diagram illustrating that a method for compensating brightness provided by at least one embodiment is applied for a display panel.

At least one embodiment of the present disclosure provides a method for detecting compensation parameters of brightness of a display panel, the method for detecting compensation parameters of brightness can detect the compensation parameters of the brightness of the display panel, for example, the compensation parameters that obtained can be used to compensate for brightness when the display panel performs a display operation. For example, FIG. 2 illustrates a display panel, the display region of the display panel includes a first region 111 and a second region 112, the first region 111 includes a plurality of first pixel units arranged in a first array, the second region 112 includes a plurality of second pixel units arranged in a second array, and the first region 111 and the second region 112 are different regions. For example, as illustrated in FIG. 2, the display panel is an OLED display panel including the "notch region" 120. For example, the first region 111 is a region close to the "notch region" 120, and the second region 112 is the region other than the first region 111 in the display region of the display panel. For example, the first region 111 and the second region 112 of the display panel are regions for displaying images, devices such as cameras, sensors, and the like are provided in the "notch region" 120, and the "notch region" 120 is generally not used for displaying images.

It should be noted that, in the embodiments of the present disclosure, the division of the first region 111 and the second region 112 is not limited to the case illustrated in FIG. 2, other methods can be adopted according to the actual needs, and the embodiments of the present disclosure do not limit this. The method for detecting compensation parameters of brightness provided by the embodiment of the present disclosure is used for two regions with a large difference in panel layout, so as long as two different regions are selected in the display region of the display panel, the above method for detecting compensation parameters of brightness can be implemented.

For example, as illustrated in FIG. 2, the size of the first pixel unit in the first region 111 of the display panel and the size of the second pixel unit in the second region 112 of the display panel may be the same. The embodiments of the present disclosure include, but are not limited to this case, for example, the size of the first pixel unit in the first region 111 of the display panel and the size of the second pixel unit in the second region 112 of the display panel may also be different.

It should be noted that in the embodiments of the present disclosure, the region for displaying images in the display panel is referred to as the display region, and the region for providing devices instead of displaying images is referred to as the "notch region". The following embodiments are the same as this and are not described in detail.

For example, the method for detecting compensation parameters of brightness includes the following operation steps.

Step S100: selecting a first target region TG1 from the first region 111, and determining a first compensation parameter according to the brightness of the first target region TG1; for example, the first compensation parameter is used for at least part of the first pixel units in the first region 111 to perform brightness compensation.

Step S200: selecting a second target region TG2 from the second region 112, and determining a second compensation parameter according to the brightness of the second target region TG2; for example, the second compensation parameter is used for at least part of the second pixel units in the second region 112 to perform brightness compensation.

For example, in the case where the first target region TG1 is selected, the first target region TG1 may include a first pixel unit, brightness of which is lower than a preset value, in the first region 111, for example, include the first pixel unit having the lowest brightness in the first region 111. For example, the first target region TG1 may include 50 rows and 50 columns of first pixel units, the embodiments of the present disclosure include but are not limited thereto, for example, the first target region TG1 may also include more or less first pixel units. For example, the first region 111 includes a protruding region located at a side of the display panel, and the protruding region is a region close to the "notch region" 120.

For example, in the case where the second target region TG2 is selected, the second target region TG2 may include a second pixel unit, which is located at a center position, in the second region 112. For example, if the display panel includes 3120 rows of pixel units (including the first pixel units and the second pixel units), the second target region TG2 may include the second pixel units located at row 1560. For example, the second target region TG2 may include 100 rows and 100 columns of second pixel units, the embodiments of the present disclosure include but are not limited thereto, for example, the second target region TG2 may also include more or less second pixel units. For example, the second region 112 includes a region located at the center position of the display region, that is, the second region 112 is the region other than the first region 111 in the display region of the display panel.

In the method for detecting compensation parameters of brightness provided by some embodiments of the present disclosure, the first target region TG1 is selected from the first region 111, then the first compensation parameter is determined, and the first compensation parameter is used for at least part of the first pixel units in the first region 111 to perform brightness compensation; and the second target region TG2 is selected from the second region 112, then the second compensation parameter is determined, and the second compensation parameter is used for at least part of the second pixel units in the second region 112 to perform brightness compensation. It can be seen from the above that the panel layouts of the first region 111 and the second region 112 are quite different, so the characteristics of the first pixel units in the first region 111 and the characteristics of the second pixel units in the second region 112 are quite different. The method for detecting compensation parameters of brightness acquires corresponding compensation parameters for the first region 111 and the second region 112 respectively, which can alleviate or avoid the problems of poor display such as uneven brightness between the first region 111 and the second region 112 of the display panel. For example, the above-mentioned method for detecting compensation parameters of brightness may operate the display panel at the manufacturer side to obtain the compensation parameters (including the first compensation parameter and the second compensation parameter), and then may use the compensation parameters at the user side to perform brightness compensation on the display panel, for example.

In the method for detecting compensation parameters of brightness provided by some embodiments of the present disclosure, for example, the first region 111 is divided into a plurality of first compensation units (or a plurality of groups of pixel units), the first compensation unit includes a group of pixel units, the group of pixel units includes at least one first pixel unit, and the above-mentioned step of that determining the first compensation parameter according to the brightness of the first target region TG1 includes the following operation step.

Step S110: obtaining a grayscale data corresponding to a brightness data of each of the first compensation units according to a gamma curve of the display panel, and causing the each of the first compensation units to determine a corresponding first compensation parameter according to a grayscale data corresponding to the first target region TG1.

Figure 4:
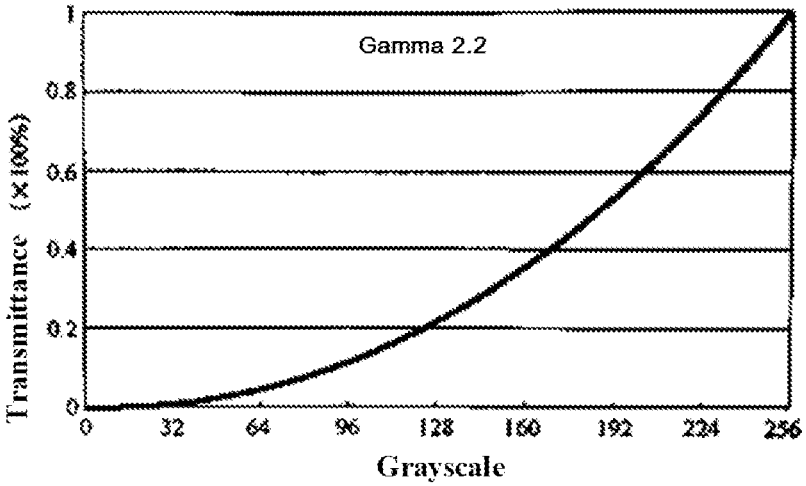
FIG. 4 is a gamma curve of a display panel.

For example, FIG. 4 illustrates a gamma curve of the relationship between the grayscale value and the transmittance of a display panel, the gamma value of the display panel is 2.2, and the transmittance is equal to the ratio of brightness to maximum brightness. It should be noted that the embodiments of the present disclosure do not limit the gamma value of the display panel. In the above step S110, the brightness data may be converted into the corresponding grayscale data according to the gamma curve of the display panel, and then the first compensation parameter corresponding to each first compensation unit may be obtained according to the grayscale data.

For example, each first compensation unit includes 4 rows and 4 columns of first pixel units, the embodiments of the present disclosure include but are not limited thereto, and the first compensation unit may include more or less first pixel units. In the above method, the first region 111 is divided into a plurality of first compensation units, and then the first region 111 determines the corresponding first compensation parameter with using the first compensation unit as the smallest unit. In this way, the amount of data to be stored can be greatly reduced and the cost can be reduced. For example, the first region 111 may not be divided into the first compensation units, and the first pixel unit is directly used as the smallest unit to determine the first compensation parameter. In this way, a large amount of data needs to be stored, but the compensation effect will be better, that is, the problems of poor display such as display mura, and the like can be alleviated better.

For example, the second region 112 is divided into a plurality of second compensation units (or a plurality of groups of pixel units), the second compensation unit includes a group of pixel units, the group of pixel units includes at least one second pixel unit, and the above-mentioned step of that determining the second compensation parameter according to the brightness of the second target region TG2 includes the following operation step.

Step S210: obtaining a grayscale data corresponding to a brightness data of each of the second compensation units according to the gamma curve of the display panel, and causing the each of the second compensation units to determine a corresponding second compensation parameter according to a grayscale data corresponding to the second target region TG2.

For example, in the above step S210, the brightness data may be converted into the corresponding grayscale data according to the gamma curve of the display panel, and then the second compensation parameter corresponding to each second compensation unit may be obtained according to the grayscale data.

For example, each second compensation unit includes 4 rows and 4 columns of second pixel units, the embodiments of the present disclosure include but are not limited thereto, and the second compensation unit may include more or less second pixel units. In the above method, the second region 112 is divided into a plurality of second compensation units, and then the second region 112 determines the corresponding second compensation parameter with using the second compensation unit as the smallest unit. In this way, the amount of data to be stored can be greatly reduced and the cost can be reduced. For example, the second region 112 may not be divided into the second compensation units, and the second pixel unit is directly used as the smallest unit to determine the second compensation parameter. In this way, a large amount of data needs to be stored, but the compensation effect will be better, that is, the problems of poor display such as display mura, and the like can be alleviated better.

For example, in the method for detecting compensation parameters of brightness provided by some embodiments of the present disclosure, the first compensation unit and the second compensation unit are equal in size. That is, the smallest unit for the brightness compensation of the first region 111 and the smallest unit for the brightness compensation of the second region 112 are equal, in this way, the problems of poor display such as display mura, and the like can be further alleviated to a certain extent.

In the method for detecting compensation parameters of brightness provided by some embodiments of the present disclosure, the above-mentioned step of that causing the each of the first compensation units to determine the corresponding first compensation parameter according to the grayscale data corresponding to the first target region TG1 includes the following operation steps.

Step S111: inputting a monochromatic image with a first grayscale value to the first region 111. For example, in the case where the grayscale value is still represented by a data of 8-bit (256 grayscale values from 0 to 255), the maximum grayscale value is 255, for example, the first grayscale value may be a value being ⅛ of the maximum grayscale value, that is about 31. It should be noted that the embodiments of the present disclosure do not limit the selection of the first grayscale value.

Step S112: in the case that is described in step S111, acquiring a brightness data set of all the first pixel units in the first region 111 and taking the brightness data set as a first brightness data, and obtaining a first target brightness value $YG_1$ of the first target region TG1 according to the first brightness data, in which the first target brightness value $YG_1$ is an average value of brightness data of all the first pixel units in the first target region; obtaining a first original brightness value $XG_1$ of the each of the first compensation units according to the first brightness data, in which the first original brightness value $XG_1$ is an average value of brightness data of all the first pixel units in the each of the first compensation units. For example, when the monochromatic image with the first grayscale value (e.g., 31) is input to the first region 111 (in an ideal state, all the first pixel units in the first region 111 may display the same brightness), the brightness data set of all the first pixel units in the first region 111 is acquired and taken as the first brightness data.

For example, in some embodiments, an image capturing device may be used to photograph the display panel to obtain a first image data, and then the first brightness data is acquired according to the first image data and configuration parameters of the image capturing device. For example, the resolution of the image capturing device may be higher than the resolution of the display panel. For example, the image capturing device photographs the display panel to obtain the first image data, the first image data includes brightness information of the light emitted by the display panel, and the first brightness data can be acquired in combination with the configuration parameters of the image capturing device. For example, the image capturing device may adopt a CMOS camera or a CCD camera. In the case where the configuration parameters (for example, exposure time) of the camera are changed, the first image data that obtained is also different, so the first brightness data is extracted from the first image data in combination with the configuration parameters of the image capturing device.

After the first brightness data is obtained, the brightness data of all the first pixel units in each first compensation unit may be averaged according to the correspondence between the first brightness data and the display panel to obtain the first original brightness value $XG_1$ corresponding to each first compensation unit; correspondingly, the brightness data of all the first pixel units in the first target region TG1 is averaged to obtain the first target brightness value $YG_1$. It should be noted that the embodiments of the present disclosure include but are not limited to this. For example, a maximum value (or a certain ratio value of the average value) may also be selected from the brightness data of all the first pixel units in each first compensation unit to obtain the first original brightness value $XG_1$ corresponding to each first compensation unit; correspondingly, a maximum value (or a certain ratio value of the average value) may also be selected from the brightness data of all the first pixel units in the first target region TG1 to obtain the first target brightness value $YG_1$.

Step S113: obtaining a first target grayscale value $Y_1$ corresponding to the first target brightness value $YG_1$ according to the gamma curve, and obtaining a first original grayscale value $X_1$ corresponding to the first original brightness value $XG_1$ according to the gamma curve. For example, the gamma curve of the display panel may adopt the gamma curve illustrated in FIG. 4, after the first target brightness value $YG_1$ and the first original brightness value $XG_1$ are obtained, the corresponding transmittance (the transmittance is equal to the ratio of the brightness to the maximum brightness) is obtained by calculation, and then the corresponding grayscale value is obtained according to the gamma curve.

Step S114: inputting a monochromatic image with a second grayscale value to the first region 111. For example, the second grayscale value may be a value being ⅞ of the maximum grayscale value, that is about 223. It should be noted that the embodiments of the present disclosure do not limit the selection of the second grayscale value. In the embodiments of the present disclosure, the selection of the first grayscale value and the second grayscale value may be selected as needed, as long as the first grayscale value and the second grayscale value are different. For example, the first grayscale value may be selected to be a relatively small grayscale value, and the second grayscale value may be selected to be a relatively large grayscale value, so that the brightness of different intervals can be covered when calculating the compensation parameters, as a result, the problems of poor display such as uneven brightness, and the like can be alleviated better.

Step S115: in the case that is described in step S114, acquiring a brightness data set of all the first pixel units in the first region 111 and taking the brightness data set as a second brightness data, and obtaining a second target brightness value $YG_2$ of the first target region TG1 according to the second brightness data, in which the second target brightness value $YG_2$ is an average value of brightness data of all the first pixel units in the first target region; obtaining a second original brightness value $XG_2$ of the each of the first compensation units according to the second brightness data, in which the second original brightness value $XG_2$ is an average value of brightness data of all the first pixel units in the each of the first compensation units. The step S115 is similar to the above step S112 and is not repeated here.

Step S116: obtaining a second target grayscale value $Y_2$ corresponding to the second target brightness value $YG_2$ according to the gamma curve, and obtaining a second original grayscale value $X_2$ corresponding to the second original brightness value $XG_2$ according to the gamma curve.

Step S117: calculating a first compensation gain value $A_1$ and a first compensation deviation value $B_1$ corresponding to the each of the first compensation units according to the following equations:

$$A_1*X_1+B_1=Y_1,\ A_1*X_2+B_1=Y_2.$$

The first compensation parameter includes the first compensation gain value $A_1$ and the first compensation deviation value $B_1$.

It should be noted that, the first compensation parameter (the first compensation gain value $A_1$ and the first compensation deviation value $B_1$) obtained through the above steps is corresponding to one first compensation unit, and other first compensation units in the first region 111 may be obtained by using the same method as above. For example, after the display panel is manufactured, the manufacturer may implement the above-mentioned method for detecting the compensation parameters of brightness during the process of the quality inspection of the display panel, for example, the first compensation parameters obtained corresponding to the first compensation units in the first region 111 may be stored in a memory. Then, for example, in the case where the display panel is used at the user side, the first compensation parameters can be directly called from the memory to complete the brightness compensation of the display panel, thereby alleviating or avoiding the problems of poor display such as display mura, and the like.

In the method for detecting compensation parameters of brightness provided by some embodiments of the present disclosure, the above-mentioned step of that causing the each of the second compensation units to determine the corresponding second compensation parameter according to the grayscale data corresponding to the second target region TG2 includes the following operation steps.

Step S211: inputting the monochromatic image with the first grayscale value to the second region 112. For example, in some embodiments, the step S211 and the above step S111 may be performed simultaneously, that is, the monochromatic image with the first grayscale value is simultaneously input to the display panel (including the first region 111 and the second region 112), and in this way, the method for detecting compensation parameters of brightness may be simplified.

Step S212: in the case that is described in step S211, acquiring a brightness data set of all the second pixel units in the second region 112 and taking the brightness data set as a third brightness data, and obtaining a third target brightness value $YG_3$ of the second target region TG2 according to the third brightness data, in which the third target brightness value $YG_3$ is an average value of brightness data of all the second pixel units in the second target region; obtaining a third original brightness value $XG_3$ of the each of the second compensation units according to the third brightness data, in which the third original brightness value $XG_3$ is an average value of brightness data of all the second pixel units in the each of the second compensation units. The step S212 is similar to the above step S112 and is not repeated here.

Step S213: obtaining a third target grayscale value $Y_3$ corresponding to the third target brightness value $YG_3$ according to the gamma curve, and obtaining a third original grayscale value $X_3$ corresponding to the third original brightness value $XG_3$ according to the gamma curve.

Step S214: inputting the monochromatic image with the second grayscale value to the second region 112. For example, in some embodiments, the step S214 and the above step S114 may be performed simultaneously, that is, the monochromatic image with the second grayscale value is simultaneously input to the display panel (including the first region 111 and the second region 112), and in this way, the method for detecting compensation parameters of brightness may be simplified.

Step S215: in the case that is described in step S214, acquiring a brightness data set of all the second pixel units in the second region 112 and taking the brightness data set as a fourth brightness data, and obtaining a fourth target brightness value $YG_4$ of the second target region TG2 according to the fourth brightness data, in which the fourth target brightness value $YG_4$ is an average value of brightness data of all the second pixel units in the second target region; obtaining a fourth original brightness value $XG_4$ of the each of the second compensation units according to the fourth brightness data, in which the fourth original brightness value $XG_4$ is an average value of brightness data of all the second pixel units in the each of the second compensation units.

Step S216: obtaining a fourth target grayscale value $Y_4$ corresponding to the fourth target brightness value $YG_4$ according to the gamma curve, and obtaining a fourth original grayscale value $X_4$ corresponding to the fourth original brightness value $XG_4$ according to the gamma curve.

Step S217: calculating a second compensation gain value $A_2$ and a second compensation deviation value $B_2$ corresponding to the each of the second compensation units according to the following equations:

$$A_2*X_3+B_2=Y_3,\ A_2*X_4+B_2=Y_4.$$

The second compensation parameter includes the second compensation gain value $A_2$ and the second compensation deviation value $B_2$.

It should be noted that, the second compensation parameter (the second compensation gain value $A_2$ and the second compensation deviation value $B_2$) obtained through the above steps is corresponding to one second compensation unit, and other second compensation units in the second region 112 may be obtained by using the same method as above. For example, after the display panel is manufactured, the manufacturer may implement the above-mentioned method for detecting the compensation parameters of brightness during the process of the quality inspection of the display panel, for example, the second compensation parameters obtained corresponding to the second compensation units in the second region 112 may be stored in a memory. Then, for example, in the case where the display panel is used at the user side, the second compensation parameters can be directly called from the memory to complete the brightness compensation of the display panel, thereby alleviating or avoiding the problems of poor display such as display mura, and the like.

Figure 3:
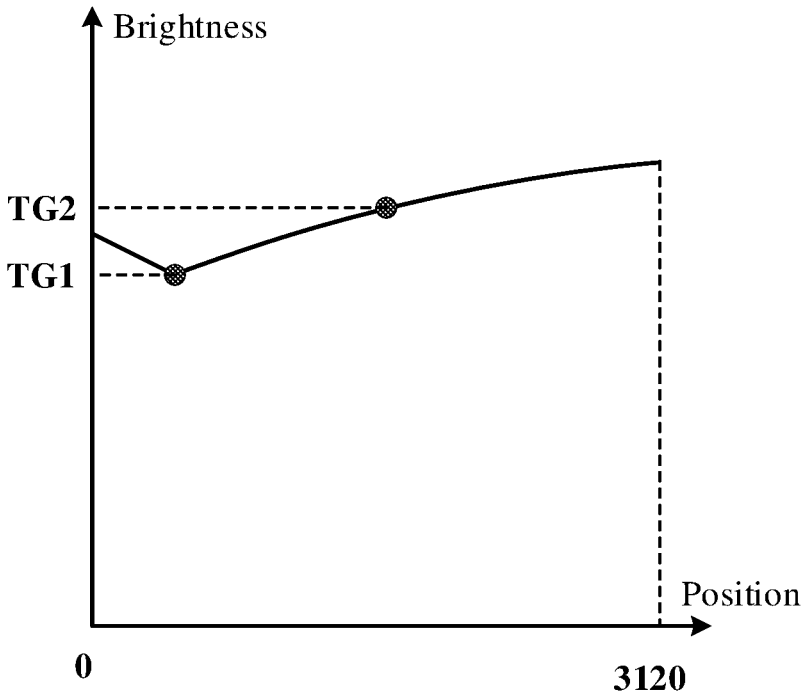
FIG. 3 is a change curve corresponding to the brightness of pixel units at different positions in the display panel corresponding to FIG. 2.

For example, FIG. 3 is a change curve corresponding to the brightness of pixel units at different positions in the display panel corresponding to FIG. 2. As illustrated in FIG. 3, the abscissa indicates the number of rows of the display panel, for example, the display panel includes 3120 rows of pixel units, and the ordinate indicates the brightness at the corresponding position. For example, in the case where the above method for detecting the compensation parameters of brightness is adopted, the first target region TG1 may select the region including the first pixel unit with the lowest brightness in the first region 111, and the second target region TG2 may select the region including the second pixel unit located at the center position in the second region 112. Of course, the embodiments of the present disclosure do not limit the selection of the first target region TG1 and the second target region TG2.

The method for detecting compensation parameters of brightness provided by some embodiments of the present disclosure further includes the following operation steps.

Step S120: filtering the first brightness data to eliminate noise after obtaining the first brightness data.

Step S220: filtering the second brightness data to eliminate noise after obtaining the second brightness data.

For example, filtering the first brightness data can eliminate noise, for example, points with abnormal data may be filtered out. For example, step S120 may be performed using a low-pass filter, and similarly step S220 may be performed using a low-pass filter. It should be noted that the filtering operation may be performed in a conventional manner in the art, and the embodiments of the present disclosure do not limit this.

By filtering the first brightness data and the second brightness data, the method for detecting the compensation parameters of brightness provided by some embodiments of the present disclosure can avoid the influence of the points with abnormal data on the calculation of the compensation parameters, thereby further improving the effect of the brightness compensation.

At least one embodiment of the present disclosure further provides a method for compensating brightness which is used for the user side, for example, the method for compensating brightness can compensate the brightness of the display panel. For example, FIG. 2 illustrates a display panel, the display region of the display panel includes a first region 111 and a second region 112, the first region 111 includes a plurality of first pixel units arranged in a first array, the second region 112 includes a plurality of second pixel units arranged in a second array, and the first region 111 and the second region 112 are different regions. For example, as illustrated in FIG. 2, the display panel is an OLED display panel including the "notch region" 120. For example, the first region 111 is a region close to the "notch region" 120, and the second region 112 is the region other than the first region 111 in the display region of the display panel. For example, the first region 111 and the second region 112 of the display panel are regions for displaying images, devices such as cameras, sensors, and the like are provided in the "notch region" 120, and the "notch region" 120 is generally not used for displaying images.

For example, the method for compensating brightness includes the following operation steps.

Step S300: causing at least part of the first pixel units in the first region 111 to perform brightness compensation according to a first compensation parameter. For example, the first compensation parameter is determined based on the brightness of a first target region TG1, and the first region 111 includes the first target region TG1.

Step S400: causing at least part of the second pixel units in the second region 112 to perform brightness compensation according to a second compensation parameter. For example, the second compensation parameter is determined based on the brightness of a second target region TG2, and the second region 112 includes the second target region TG2.

In the method for compensating brightness provided by some embodiments of the present disclosure, for example, the first region 111 is divided into a plurality of first compensation units, then the above step S300 includes the following operation steps.

Step S310: causing the first region 111 to perform the brightness compensation according to the first compensation parameter with using the first compensation units as a smallest unit. For example, the first region 111 is divided into a plurality of first compensation units (or a plurality of groups of pixel units), and then the first region 111 is subjected to the brightness compensation according to the corresponding first compensation parameter with using the first compensation unit as the smallest unit. In this way, the amount of data to be stored can be greatly reduced and the cost can be reduced. For example, the first region 111 may not be divided into the first compensation units, and the first pixel unit is directly used as the smallest unit to perform the brightness compensation. In this way, a large amount of data needs to be stored, but the compensation effect will be better, that is, the problems of poor display such as display mura, and the like can be alleviated better.

For example, the second region 112 is divided into a plurality of second compensation units, then the above step S400 includes the following operation steps.

Step S410: causing the second region 112 to perform the brightness compensation according to the second compensation parameter with using the second compensation units as a smallest unit. For example, the second region 112 is divided into a plurality of second compensation units (or a plurality of groups of pixel units), and then the second region 112 is subjected to the brightness compensation according to the corresponding second compensation parameter with using the second compensation unit as the smallest unit. In this way, the amount of data to be stored can be greatly reduced and the cost can be reduced. For example, the second region 112 may not be divided into the second compensation units, and the second pixel unit is directly used as the smallest unit to perform the brightness compensation. In this way, a large amount of data needs to be stored, but the compensation effect will be better, that is, the problems of poor display such as display mura, and the like can be alleviated better.

In the method for compensating brightness provided by some embodiments of the present disclosure, for example, the first compensation parameter includes a first compensation gain value $A_1$ and a first compensation deviation value $B_1$, and the brightness of a first pixel unit in the first compensation unit is compensated according to the following equation:

$$A_1 * X_{O1} + B_1 = Y_{A1}.$$

$X_{O1}$ is a grayscale value of the first pixel unit in the first compensation unit before the first pixel unit is compensated, and $Y_{A1}$ is a grayscale value of the first pixel unit in the first compensation unit after the first pixel unit is compensated.

For example, the second compensation parameter includes a second compensation gain value $A_2$ and a second compensation deviation value $B_2$, and the brightness of a second pixel unit in the second compensation unit is compensated according to the following equation:

$$A_2 * X_{O2} \pm B_2 = Y_{A2}.$$

$X_{O2}$ is a grayscale value of the second pixel unit in the second compensation unit before the second pixel unit is compensated, and $Y_{A2}$ is a grayscale value of the second pixel unit in the second compensation unit after the second pixel unit is compensated.

For the first compensation gain value $A_1$, the first compensation deviation value $B_1$, the second compensation gain value $A_2$, and the second compensation deviation value $B_2$, reference may be made to the corresponding descriptions in the foregoing embodiments, and details are not described here again.

For example, after the display panel is manufactured, the manufacturer may obtain the first compensation parameters of the first compensation units corresponding to the first region 111 and the second compensation parameters of the second compensation units corresponding to the second region 112. Then, the above first compensation parameters and the second compensation parameters may be stored in a memory, for example, in the case where the display panel is used at the user side, the first compensation parameters and the second compensation parameters can be directly called from the memory to complete the brightness compensation of the display panel, thereby alleviating or avoiding the problems of poor display such as display mura, and the like.

Figure 5:
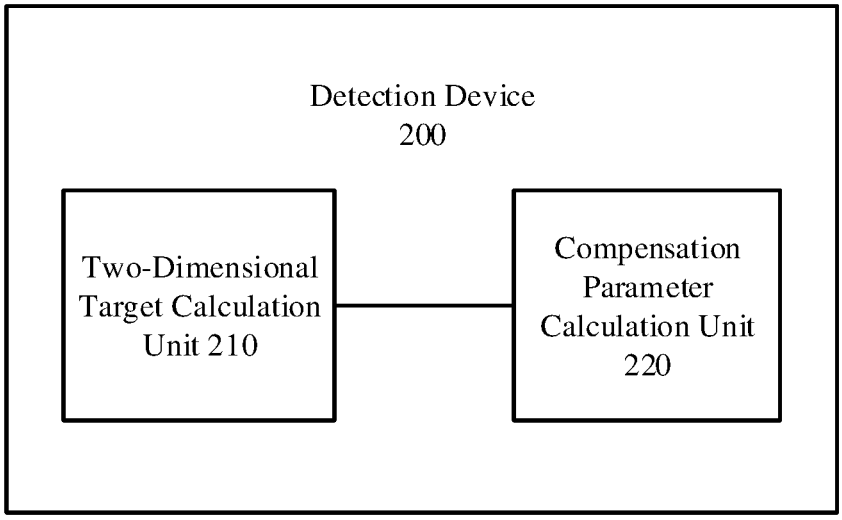
FIG. 5 is a schematic diagram of a brightness compensation device provided by at least one embodiment of the present disclosure.

At least one embodiment of the present disclosure further provides a detection device 200 for detecting compensation parameters of brightness, and the detection device 200 for detecting compensation parameters of brightness can compensate the brightness of the display panel. For example, FIG. 2 illustrates a display panel, the display region of the display panel includes a first region 111 and a second region 112, the first region 111 includes a plurality of first pixel units arranged in a first array, the second region 112 includes a plurality of second pixel units arranged in a second array, and the first region 111 and the second region 112 are different regions. For example, as illustrated in FIG. 5, the detection device 200 for detecting compensation parameters of brightness includes a two-dimensional target calculation unit 210 and a compensation parameter calculation unit 220.

For example, the two-dimensional target calculation unit 210 is configured to select a first target region TG1 from the first region 111 and select a second target region TG2 from the second region 112. For the descriptions of the first target region TG1 and the second target region TG2, reference may be made to the corresponding descriptions in the above embodiments regarding the method for detecting compensation parameters of brightness, which is not repeated here.

For example, the compensation parameter calculation unit 220 is configured to determine a first compensation parameter according to the brightness of the first target region TG1, for at least part of the first pixel units in the first region 111 to perform brightness compensation according to the first compensation parameter, and to determine a second compensation parameter according to the brightness of the second target region TG2, for at least part of the second pixel units in the second region 112 to perform brightness compensation according to the second compensation parameter.

The detection device 200 for detecting compensation parameters of brightness provided by some embodiments of the present disclosure may acquire the first compensation parameters and the second compensation parameters for the first region 111 and the second region 112, respectively. For example, the first compensation parameters and the second compensation parameters may be provided to a driving circuit of the display panel, and the driving circuit can use the first compensation parameters and the second compensation parameters to compensate the luminous brightness of the display panel when driving the display panel for display operation, thereby alleviating or avoiding the problems of poor display such as uneven brightness, and the like of the display panel.

For example, the first region 111 is divided into a plurality of first compensation units (or a plurality of groups of pixel units), and the first compensation unit includes at least one first pixel unit. The two-dimensional target calculation unit 210 is further configured to obtain a grayscale data corresponding to a brightness data of each of the first compensation units according to the gamma curve of the display panel, and the compensation parameter calculation unit 220 is further configured to determine a first compensation parameter corresponding to the each of the first compensation units according to a grayscale data corresponding to the first target region TG1.

For example, the second region 112 is divided into a plurality of second compensation units (or a plurality of groups of pixel units), and the second compensation unit includes at least one second pixel unit. The two-dimensional target calculation unit 210 is further configured to obtain a grayscale data corresponding to a brightness data of each of the second compensation units according to the gamma curve of the display panel, and the compensation parameter calculation unit 220 is further configured to determine a second compensation parameter corresponding to the each of the second compensation units according to a grayscale data corresponding to the second target region TG2.

For example, both the two-dimensional target calculation unit 210 and the compensation parameter calculation unit 220 in the detection device 200 for detecting compensation parameters of brightness provided by the embodiments of the present disclosure may be implemented as a calculation apparatus. The calculation apparatus may include a processor and a storage medium, the storage medium stores computer instructions executable by the processor, and the computer instructions are capable of being executed by the processor to implement the function of the two-dimensional target calculation unit 210 or the compensation parameter calculation unit 220 described above. For example, in the detection device 200 for detecting compensation parameters of brightness provided by the embodiments of the present disclosure, the two-dimensional target calculation unit 210 and the compensation parameter calculation unit 220 may also be implemented by the same device.

Figure 6:
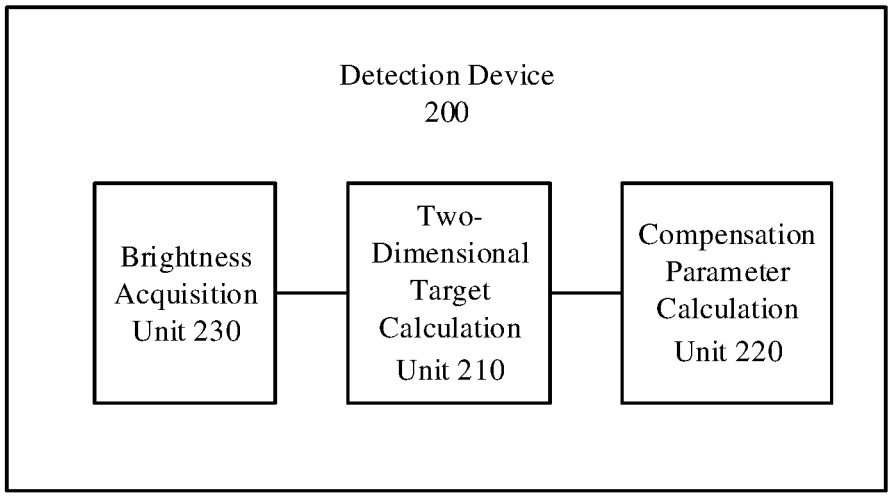
FIG. 6 is a schematic diagram of another brightness compensation device provided by at least one embodiment of the present disclosure.

As illustrated in FIG. 6, the detection device 200 for detecting compensation parameters of brightness provided by some embodiments of the present disclosure further includes a brightness acquisition unit 230.

The two-dimensional target calculation unit 210 is further configured to input a monochromatic image with a first grayscale value to the first region 111, and the brightness acquisition unit 230 is configured to acquire a brightness data set of all the first pixel units in the first region 111 when the first region 111 displays the monochromatic image with the first grayscale value, and to take the brightness data set as a first brightness data.

The two-dimensional target calculation unit 210 is further configured to obtain a first target brightness value $YG_1$ of the first target region TG1 according to the first brightness data, the first target brightness value $YG_1$ is an average value of brightness data of all the first pixel units in the first target region TG1, the two-dimensional target calculation unit 210 is further configured to obtain a first original brightness value $XG_1$ of the each of the first compensation units according to the first brightness data, and the first original brightness value $XG_1$ is an average value of brightness data of all the first pixel units in the each of the first compensation units.

The two-dimensional target calculation unit 210 is further configured to obtain a first target grayscale value $Y_1$ corresponding to the first target brightness value $YG_1$ according to the gamma curve, and to obtain a first original grayscale value $X_1$ corresponding to the first original brightness value $XG_1$ according to the gamma curve.

The two-dimensional target calculation unit 210 is further configured to input a monochromatic image with a second grayscale value to the first region 111, and the brightness acquisition unit 230 is further configured to acquire a brightness data set of all the first pixel units in the first region 111 when the first region 111 displays the monochromatic image with the second grayscale value and to take the brightness data set as a second brightness data;

The two-dimensional target calculation unit 210 is further configured to obtain a second target brightness value $YG_2$ of the first target region TG1 according to the second brightness data, the second target brightness value $YG_2$ is an average value of brightness data of all the first pixel units in the first target region TG1, the two-dimensional target calculation unit 210 is further configured to obtain a second original brightness value $XG_2$ of the each of the first compensation units according to the second brightness data, and the second original brightness value $XG_2$ is an average value of brightness data of all the first pixel units in the each of the first compensation units.

The two-dimensional target calculation unit 210 is further configured to obtain a second target grayscale value $Y_2$ corresponding to the second target brightness value $YG_2$ according to the gamma curve, and to obtain a second original grayscale value $X_2$ corresponding to the second original brightness value $XG_2$ according to the gamma curve.

The compensation parameter calculation unit 220 is further configured to calculate a first compensation gain value $A_1$ and a first compensation deviation value $B_1$ corresponding to the first compensation unit according to the following equations:

$$A_1*X_1+B_1=Y_1,\ A_1*X_2+B_1=Y_2.$$

The first compensation parameter includes the first compensation gain value $A_1$ and the first compensation deviation value $B_1$.

For the above descriptions of acquiring the first compensation parameter, reference may be made to the corresponding descriptions in the above embodiments of the method for detecting compensation parameters of brightness, and details are not described here again.

For example, the brightness acquisition unit 230 may adopt an image capturing device, for example, the image capturing device includes a CMOS camera, or a CCD camera, or the like.

In the detection device 200 for detecting compensation parameters of brightness provided by some embodiments of the present disclosure, the two-dimensional target calculation unit 210 is further configured to input the monochromatic image with the first grayscale value to the second region 112, and the brightness acquisition unit 230 is further configured to acquire a brightness data set of all the second pixel units in the second region 112 when the second region 112 displays the monochromatic image with the first grayscale value and to take the brightness data set as a third brightness data.

The two-dimensional target calculation unit 210 is further configured to obtain a third target brightness value $YG_3$ of the second target region TG2 according to the third brightness data, the third target brightness value $YG_3$ is an average value of brightness data of all the second pixel units in the second target region TG2, the two-dimensional target calculation unit 210 is further configured to obtain a third original brightness value $XG_3$ of the each of the second compensation units according to the third brightness data, and the third original brightness value $XG_3$ is an average value of brightness data of all the second pixel units in the each of the second compensation units.

The two-dimensional target calculation unit 210 is further configured to obtain a third target grayscale value $Y_3$ corresponding to the third target brightness value $YG_3$ according to the gamma curve, and to obtain a third original grayscale value $X_3$ corresponding to the third original brightness value $XG_3$ according to the gamma curve.

The two-dimensional target calculation unit 210 is further configured to input the monochromatic image with the second grayscale value to the second region 112, and the brightness acquisition unit 230 is further configured to acquire a brightness data set of all the second pixel units in the second region 112 when the second region 112 displays the monochromatic image with the second grayscale value and to take the brightness data set as a fourth brightness data.

The two-dimensional target calculation unit 210 is further configured to obtain a fourth target brightness value $YG_4$ of the second target region TG2 according to the fourth brightness data, the fourth target brightness value $YG_4$ is an average value of brightness data of all the second pixel units in the second target region TG2, the two-dimensional target calculation unit 210 is further configured to obtain a fourth original brightness value $XG_4$ of the each of the second compensation units according to the fourth brightness data, and the fourth original brightness value $XG_4$ is an average value of brightness data of all the second pixel units in the each of the second compensation units.

The two-dimensional target calculation unit 210 is further configured to obtain a fourth target grayscale value $Y_4$ corresponding to the fourth target brightness value $YG_4$ according to the gamma curve, and to obtain a fourth original grayscale value $X_4$ corresponding to the fourth original brightness value $XG_4$ according to the gamma curve.

The compensation parameter calculation unit 220 is further configured to calculate a second compensation gain value $A_2$ and a second compensation deviation value $B_2$ corresponding to the second compensation unit according to the following equations:

$$A_2*X_3+B_2=Y_3,\ A_2*X_4+B_2=Y_4.$$

The second compensation parameter includes the second compensation gain value $A_2$ and the second compensation deviation value $B_2$.

Figure 7:
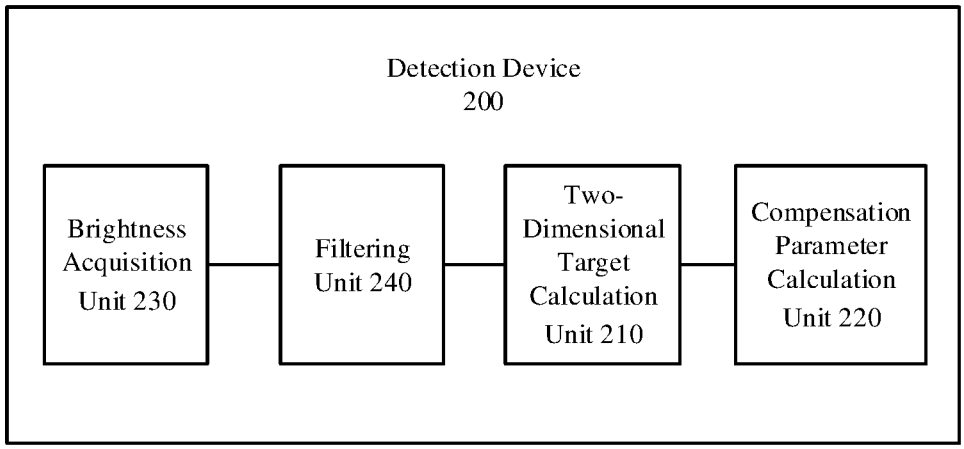
FIG. 7 is a schematic diagram of still another brightness compensation device provided by at least one embodiment of the present disclosure.

As illustrated in FIG. 7, the detection device 200 for detecting compensation parameters of brightness provided by some embodiments of the present disclosure further includes a filtering unit 240, and the filtering unit 240 is configured to filter the first brightness data to eliminate noise after the brightness acquire unit 230 obtains the first brightness data, and to filter the second brightness data to eliminate noise after the brightness acquire unit 230 obtains the second brightness data.

For example, the filtering unit 240 may adopt a low-pass filter.

The detection device 200 for detecting compensation parameters of brightness provided by some embodiments of the present disclosure uses the filtering unit 240 to filter the first brightness data and the second brightness data, which can avoid the influence of the points with abnormal data on the calculation of the compensation parameters, thereby further improving the effect of the brightness compensation.

Figure 8:
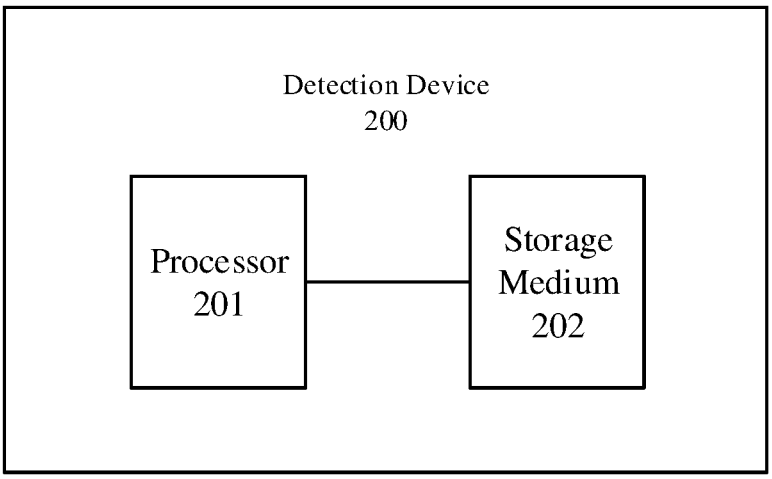
FIG. 8 is a schematic diagram of still another brightness compensation device provided by at least one embodiment of the present disclosure.

Some embodiments of the present disclosure further provide a detection device 200 for detecting compensation parameters of brightness, as illustrated in FIG. 8, the detection device 200 for detecting compensation parameters of brightness includes a processor 201 and a non-volatile storage medium 202. The storage medium 202 is configured to store computer instructions executable by the processor 201, and the computer instructions are capable of being executed by the processor 201 to implement any method for detecting compensation parameters of brightness provided by the embodiments of the present disclosure.

Figure 9:
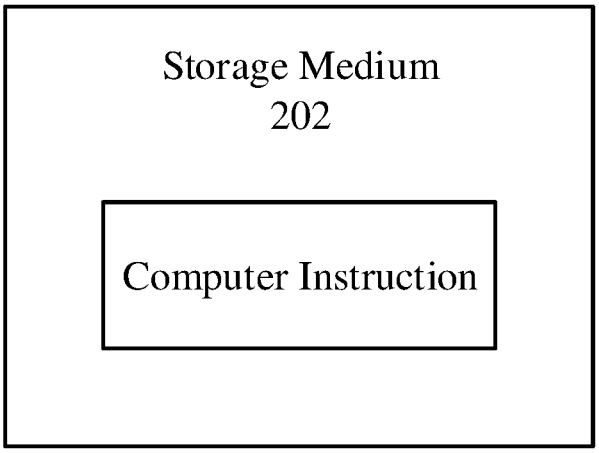
FIG. 9 is a schematic diagram of a non-volatile storage medium provided by at least one embodiment of the present disclosure.

Some embodiments of the present disclosure further provide a non-volatile storage medium 202, as illustrated in FIG. 9, the storage medium 202 stores computer instructions executable by a processor, and the computer instructions are capable of being executed by the processor to implement any method for detecting compensation parameters of brightness provided by the embodiments of the present disclosure.

For example, in one example, the storage medium 202 may be provided in a calculation apparatus, the calculation apparatus may further include a processor, and the processor can call the computer instructions stored in the storage medium 202.

In the embodiments of the present disclosure, the processor may be implemented by a universal integrated circuit chip or an application specific integrated circuit chip, for example, the integrated circuit chip may be provided on a motherboard, for example, a storage medium and a power supply circuit may also be provided on the motherboard. In addition, the processor can also be implemented by a circuit or software, hardware (circuit), firmware or any combination thereof. In the embodiments of the present disclosure, the processor may include a variety of computational structures, e.g., a complex instruction set computer (CISC) structure, and a reduced instruction set computing (RISC) structure or a structure that incorporates a plurality of instruction set combinations. In some embodiments, the processor may also be a central processor, a microprocessor, such as an X86 processor, an ARM processor, or may be an image processor (GPU) or a tensor processor (TPU), or may be a digital processor (DSP), etc.

In the embodiments of the present disclosure, the storage medium may be provided on the above-mentioned motherboard, for example, the storage medium may store instructions and/or data executed by the processor, and the data generated by executing the instructions, etc., and the data that generated may be structured data or unstructured data, etc. For example, the storage medium may include one or more computer program products. The computer program products may include various kinds of computer readable memory, e.g., volatile memory and/or nonvolatile memory. Volatile memory, for example, includes a random access memory (RAM) and/or a cache memory. Nonvolatile memory, for example, includes read-only memory (ROM), magnetic disk, optical disk, semiconductor memory (e.g., flash memory, resistive memory, etc.), and the like. One or more computer program instructions may be stored in the computer readable memory, and the processor can execute the program instructions to realize the desired functions (implemented by the processor) in the embodiments of the present disclosure.

Some embodiments of the present disclosure further provide a brightness compensation device for compensating the brightness of a display panel, the display region of the display panel includes a first region 111 and a second region 112, the first region 111 includes a plurality of first pixel units arranged in a first array, the second region 112 includes a plurality of second pixel units arranged in a second array, and the first region 111 and the second region 112 are different regions. The brightness compensation device is configured to cause at least part of the first pixel units in the first region 111 to perform brightness compensation according to a first compensation parameter, and to cause at least part of the second pixel units in the second region 112 to perform brightness compensation according to a second compensation parameter. The first compensation parameter is determined based on brightness of a first target region, and the first region includes the first target region; and the second compensation parameter is determined based on brightness of a second target region, and the second region includes the second target region.

For example, the brightness compensation device provided by the embodiment of the present disclosure may be integrated into a display device. For example, in the case where the display device is subjected to the display operation at the user side, the brightness compensation device can compensate the brightness of the display device, thereby alleviating or avoiding the problems of poor display such as display mura, and the like.

It should be noted that the brightness compensation device provided by the embodiment of the present disclosure may be integrated in the driving circuit for driving the display panel, for example, in the driving chip.

Figure 10:
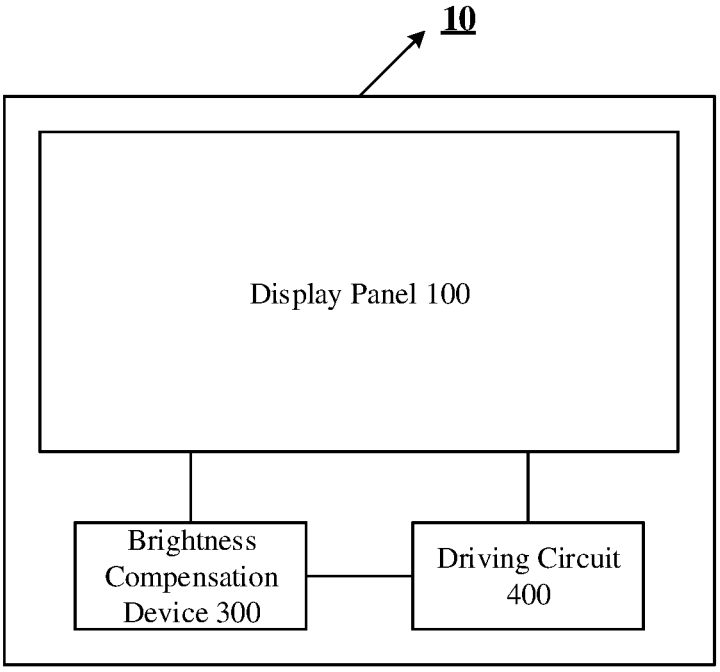
FIG. 10 is a schematic diagram of a display device provided by at least one embodiment of the present disclosure.

Some embodiments of the present disclosure further provide a display device 10, as illustrated in FIG. 10, the display device includes the brightness compensation device 300 and a display panel 100. For example, the brightness compensation device 300 may adopt any brightness compensation device provided by the above embodiments of the present disclosure. For example, the brightness compensation device 300 compensates the brightness of the display panel 100 when the display panel 100 performs a display operation.

For example, as illustrated in FIG. 10, the display device 10 further includes a driving circuit 400 for driving the display panel 100 to perform a display operation. For example, the driving circuit 400 may adopt a driving chip. For example, in some embodiments, the brightness compensation device 300 may also be integrated in the driving circuit 400.

It should be noted that the display device 10 provided by the embodiments of the present disclosure may be: a liquid crystal panel, a liquid crystal television, a display screen, an OLED panel, an OLED television, an electronic paper display device, a mobile phone, a tablet computer, a notebook computer, a digital photo frame, a navigator, or any product or component with the display function.

What have been described above are only specific implementations of the present disclosure, the protection scope of the present disclosure is not limited thereto, and the protection scope of the present disclosure should be based on the protection scope of the claims.

What is claimed is:

1. A method for detecting compensation parameters of brightness of a display panel, wherein a display region of the display panel comprises a first region and a second region, the first region comprises a plurality of first pixel units arranged in a first array, the second region comprises a plurality of second pixel units arranged in a second array, and the first region and the second region are different regions;

the method comprising:

selecting a first target region from the first region, and determining a first compensation parameter, according to a brightness of the first target region, for at least part of the first pixel units in the first region to perform brightness compensation according to the first compensation parameter; and selecting a second target region from the second region, and determining a second compensation parameter, according to a brightness of the second target region, for at least part of the second pixel units in the second region to perform brightness compensation according to the second compensation parameter;

wherein the first region is divided into a plurality of first compensation units, and the first compensation units each comprise at least one of the first pixel units;

determining the first compensation parameter, according to the brightness of the first target region, comprises:

obtaining a grayscale data corresponding to a brightness data of each of the first compensation units according to a gamma curve of the display panel, and causing the each of the first compensation units to determine a corresponding first compensation parameter according to a grayscale data corresponding to the first target region; and the second region is divided into a plurality of second compensation units, and the second compensation units each comprise at least one of the second pixel units; and determining the second compensation parameter, according to the brightness of the second target region, comprises:

obtaining a grayscale data corresponding to a brightness data of each of the second compensation units according to the gamma curve of the display panel, and causing the each of the second compensation units to determine a corresponding second compensation parameter according to a grayscale data corresponding to the second target region;

wherein causing the each of the first compensation units to determine the corresponding first compensation parameter according to the grayscale data corresponding to the first target region comprises:

inputting a monochromatic image with a first gray scale value to the first region, and then, acquiring a first brightness data set of all the first pixel units in the first region and taking the first brightness data set as a first brightness data, and obtaining a first target brightness value $YG_1$ of the first target region according to the first brightness data, wherein the first target brightness value $YG_1$ is an average value of brightness data of all the first pixel units in the first target region;

obtaining a first original brightness value $XG_1$ of the each of the first compensation units according to the first brightness data, wherein the first original brightness value $XG_1$ is an average value of brightness data of all the first pixel units in the each of the first compensation units;

obtaining a first target grayscale value $Y_1$ corresponding to the first target brightness value $YG_1$ according to the gamma curve, and obtaining a first original grayscale value $X_1$ corresponding to the first original brightness value $XG_1$ according to the gamma curve;

inputting a monochromatic image with a second grayscale value to the first region, and then, acquiring a second brightness data set of all the first pixel units in the first region and taking the second brightness data set as a second brightness data, and obtaining a second target brightness value $YG_2$ of the first target region according to the second brightness data, wherein the second target brightness value $YG_2$ is an average value of brightness data of all the first pixel units in the first target region;

obtaining a second original brightness value $XG_2$ of the each of the second compensation units according to the second brightness data, wherein the second original brightness value $XG_2$ is an average value of brightness data of all the first pixel units in the each of the first compensation units;

obtaining a second target grayscale value $Y_2$ corresponding to the second target brightness value $YG_2$ according to the gamma curve, and obtaining a second original grayscale value $X_2$ corresponding to the second original brightness value $XG_2$ according to the gamma curve; and calculating a first compensation gain value $A_1$ and a first compensation deviation value B i corresponding to the each of the first compensation units according to the following equations:

$$A_1*X_1+B_1=Y_1,\ A_1*X_2+B_1=Y_2,\ \text{and}$$

wherein the first compensation parameter comprises the first compensation gain value and the first compensation deviation value.

2. The method according to claim 1, wherein causing the each of the second compensation units to determine the corresponding second compensation parameter according to the grayscale data corresponding to the second target region comprises:

inputting the monochromatic image with the first grayscale value to the second region, and then, acquiring a third brightness data set of all the second pixel units in the second region and taking the third brightness data set as a third brightness data, and obtaining a third target brightness value $YG_3$ of the second target region according to the third brightness data, wherein the third target brightness value $YG_3$ is an average value of brightness data of all the second pixel units in the second target region;

obtaining a third original brightness value $XG_3$ of the each of the second compensation units according to the third brightness data, wherein the third original brightness value $XG_3$ is an average value of brightness data of all the second pixel units in the each of the second compensation units;

obtaining a third target grayscale value $Y_3$ corresponding to the third target brightness value $YG_3$ according to the gamma curve, and obtaining a third original grayscale value $X_3$ corresponding to the third original brightness value $XG_3$ according to the gamma curve;

inputting the monochromatic image with the second grayscale value to the second region, and then, acquiring a fourth brightness data set of all the second pixel units in the second region and taking the fourth brightness data set as a fourth brightness data, and obtaining a fourth target brightness value $YG_4$ of the second target region according to the fourth brightness data, wherein the fourth target brightness value $YG_4$ is an average value of brightness data of all the second pixel units in the second target region;

obtaining a fourth original brightness value $XG_4$ of the each of the second compensation units according to the fourth brightness data, wherein the fourth original brightness value $XG_4$ is an average value of brightness data of all the second pixel units in the each of the second compensation units;

obtaining a fourth target grayscale value $Y_4$ corresponding to the fourth target brightness value $YG_4$ according to the gamma curve, and obtaining a fourth original grayscale value $X_4$ corresponding to the fourth original brightness value $XG_4$ according to the gamma curve; and calculating a second compensation gain value $A_2$ and a second compensation deviation value $B_2$ corresponding to the each of the second compensation units according to the following equations:

$$A_2*X_3+B_2=Y_3,\ A_2*X_4+B_2=Y_4,\ \text{and}$$

wherein the second compensation parameter comprises the second compensation gain value and the second compensation deviation value.

3. The method according to claim 2, wherein inputting the monochromatic image with the first grayscale value to the first region and inputting the monochromatic image with the first grayscale value to the second region are performed simultaneously; and inputting the monochromatic image with the second grayscale value to the first region and inputting the monochromatic image with the second grayscale value to the second region are performed simultaneously.

4. The method according to claim 1, further comprising:

filtering the first brightness data to eliminate noise after obtaining the first brightness data; and filtering the second brightness data to eliminate noise after obtaining the second brightness data.

5. The method according to claim 1, wherein acquiring the first brightness data comprises:

photographing the display panel with an image capturing device to obtain a first image data; and acquiring the first brightness data according to the first image data and configuration parameters of the image capturing device.

6. The method according to claim 1, wherein the first grayscale value comprises a value being ⅛ of a maximum grayscale value, and the second grayscale value comprises a value being ⅞ of the maximum gray scale value.

7. The method according to claim 1, wherein the each of the first compensation units and the each of the second compensation units are equal in size.

8. The method according to claim 1, wherein the first target region comprises a first pixel unit, brightness of which is lower than a preset value, in the first region of the display panel.

9. The method according to claim 1, wherein the second target region comprises a second pixel unit, which is located at a center position, in the second region of the display panel.

10. The method according to claim 1, wherein the first region comprises a protruding region located at a side of the display panel, and the second region comprises a region located at a center position of the display region.

11. A non-volatile non-transitory storage medium, wherein the non-volatile non-transitory storage medium stores computer instructions executable by a processor, and the computer instructions are capable of being executed by the processor to implement the method according to claim 1.

12. A detection device for detecting compensation parameters of brightness, comprising a processor and a non-volatile non-transitory storage medium, wherein the non-volatile non-transitory storage medium is configured to store computer instructions executable by the processor, and the computer instructions are capable of being executed by the processor to implement the method according to claim 1.

13. The detection device according to claim 12, further comprising an image capturing device which is in communication with the processor and configured for capturing an image.

14. A method for compensating brightness of a display panel, wherein a display region of the display panel comprises a first region and a second region, the first region comprises a plurality of first pixel units arranged in a first array, the second region comprises a plurality of second pixel units arranged in a second array, and the first region and the second region are different regions;

the method comprises:

causing at least part of the first pixel units in the first region to perform brightness compensation according to a first compensation parameter, and causing at least part of the second pixel units in the second region to perform brightness compensation according to a second compensation parameter, wherein the first compensation parameter is determined based on brightness of a first target region, and the first region comprises the first target region; and the second compensation parameter is determined based on brightness of a second target region, and the second region comprises the second target region;

wherein the first region is divided into a plurality of first compensation units, and causing at least part of the first pixel units in the first region to perform the brightness compensation according to the first compensation parameter comprises:

causing the first region to perform the brightness compensation according to the first compensation parameter using the first compensation units as a smallest unit;

and the second region is divided into a plurality of second compensation units, and causing at least part of the second pixel units in the second region to perform the brightness compensation according to the second compensation parameter comprises:

causing the second region to perform the brightness compensation according to the second compensation parameter using the second compensation units as a smallest unit;

wherein the first compensation parameter comprises a first compensation gain value $A_1$ and a first compensation deviation value $B_1$, and brightness of a first pixel unit in one of the first compensation units is compensated according to the following equation:

$A_1*X_{O1}+B_1=Y_{A1}$, wherein $X_{O1}$ is a grayscale value of the first pixel unit in the one of the first compensation units before the first pixel unit is compensated, and $Y_{A1}$ is a grayscale value of the first pixel unit in the one of the first compensation units after the first pixel unit is compensated; and the second compensation parameter comprises a second compensation gain value Az and a second compensation deviation value $B_2$, and brightness of a second pixel unit in one of the second compensation units is compensated according to the following equation:

$A_2*X_{O2}+B_2=Y_{A2}$, wherein $X_{O2}$ is a grayscale value of the second pixel unit in the one of the second compensation units before the second pixel unit is compensated, and $Y_{A2}$ is a grayscale value of the second pixel unit in the one of the second compensation units after the second pixel unit is compensated.

15. A brightness compensation device, comprising a processor and a non-volatile non-transitory storage medium, wherein the non-volatile non-transitory storage medium is configured to store computer instructions executable by the processor, and the computer instructions are capable of being executed by the processor to implement the method according to claim 14.

16. A display device, comprising the brightness compensation device according to claim 15, and a display panel, wherein the brightness compensation device compensates brightness of the display panel when the display panel performs a display operation.

* * * * *